US005544919A

United States Patent [19]

Tinkler

[11] Patent Number: 5,544,919

[45] Date of Patent: Aug. 13, 1996

[54] FOOT SUPPORT APPARATUS FOR SUPPORTING A USER'S FOOT RELATIVE TO A SPORTSBOARD

[76] Inventor: Mike R. Tinkler, 1130 Fifth St., Hood River, Oreg. 97031

[21] Appl. No.: 331,686

[22] Filed: Oct. 31, 1994

[51] Int. Cl.[6] ..... A63C 3/00

[52] U.S. Cl. ..... 280/809; 280/87.042; 441/75

[58] Field of Search ..... 441/70, 74, 75; 280/809, 811, 14.2, 611, 623, 87.042

[56] References Cited

U.S. PATENT DOCUMENTS

| | | | |
|---|---|---|---|
| 3,593,356 | 7/1971 | Schmalfeldt | 9/310 |
| 4,159,121 | 6/1979 | Spitzke | 280/87.042 |
| 4,411,442 | 10/1983 | Rills | 280/87.042 X |
| 4,466,373 | 8/1984 | Prade et al. | 114/39 |
| 4,645,466 | 2/1987 | Ellis | 441/74 |
| 4,693,199 | 9/1987 | Omachen et al. | 441/75 X |
| 4,929,208 | 5/1990 | Corica | 441/75 |
| 5,045,006 | 9/1991 | Sperzel et al. | 441/75 |
| 5,125,859 | 6/1992 | Spurgeon | 441/75 |
| 5,167,553 | 12/1992 | Wilson | 441/75 |

*Primary Examiner*—Eric D. Culbreth
*Assistant Examiner*—Michael Mar

[57] ABSTRACT

The foot support apparatus of the present invention includes a resilient hinge including an upper portion hingedly connected to a lower portion. The lower portion is securely attachable to an upper surface of a sportsboard. A strap has a first end connectable to the upper portion and a second end being so connected so as to urge the upper portion toward the upper surface of the sportsboard. Thus, when the user's foot is placed under the upper portion, the user's foot is wedged within the hinge for support. This wedging action and commensurate ability to conveniently and easily move the foot are advantages which have not heretofore been realizable by available foot support systems.

7 Claims, 3 Drawing Sheets

FIG. 1
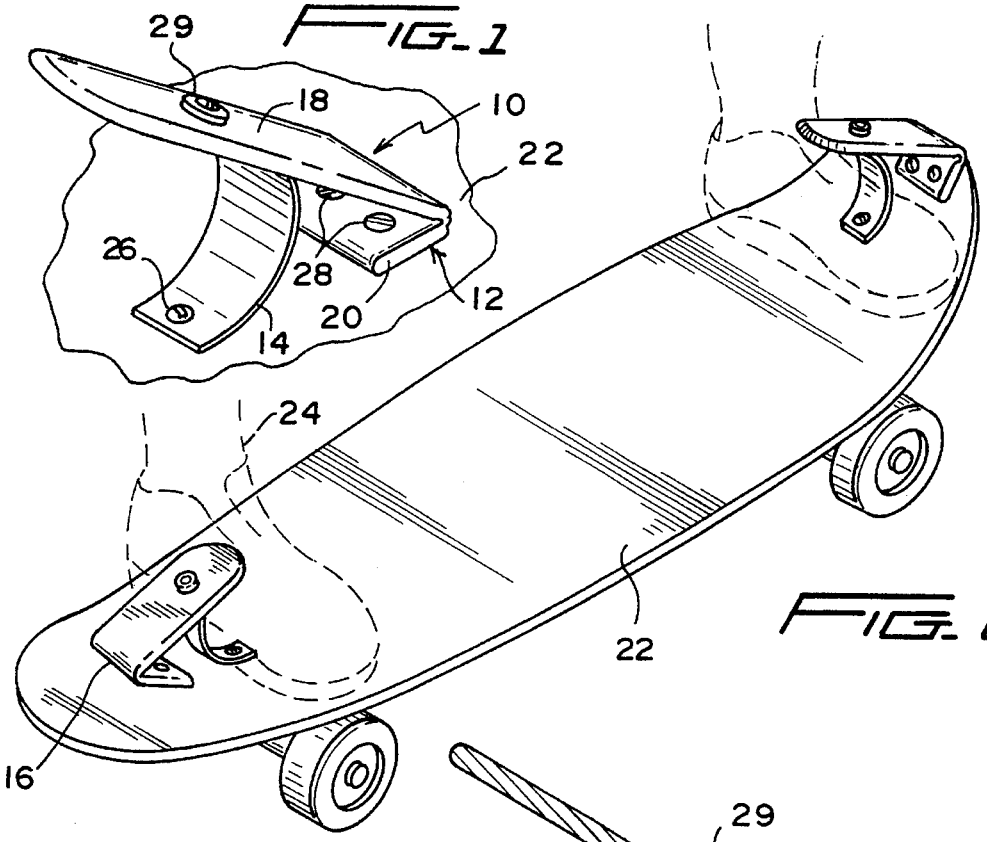
FIG. 2
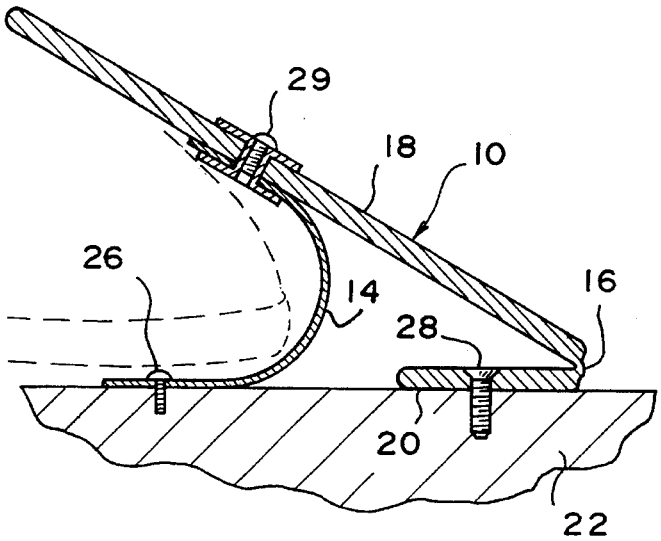
FIG. 3
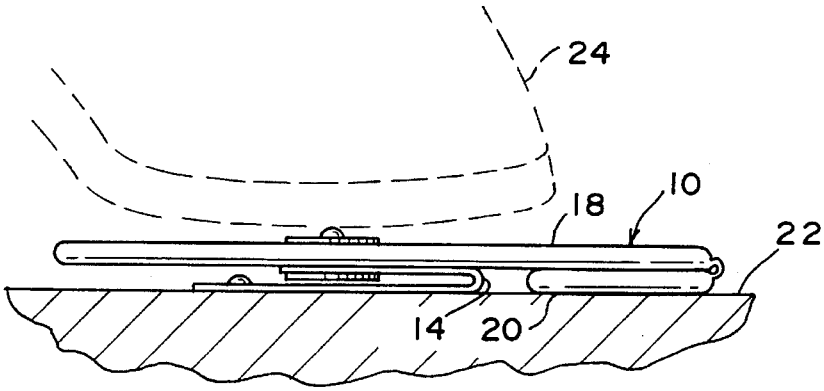
FIG. 4

FOOT SUPPORT APPARATUS FOR SUPPORTING A USER'S FOOT RELATIVE TO A SPORTSBOARD

BACKGROUND OF THE INVENTION

1. Field of the Invention

The present invention relates to various sportsboards such as skateboards, surfboards and snowboards and, more particularly to a foot support apparatus for supporting a user's foot, or feet, relative to such a sportsboard.

2. Description of the Related Art

Some degree of attachment of the user to his sportboard is becoming increasingly more desirable in various sports, such as skateboarding, snowboarding and surfing. For example, modern surfboards allow a great deal of speed and maneuverability. With these newer board designs, surfers are attempting increasingly difficult and complicated gymnastic maneuvers called "aerials." However, the limiting factor remains the difficulty in staying with the board once in the air and achieving a controlled landing. There is a great benefit if the surfer's feet were somehow attached to the surfboard and the surfer's arms and upper body are free to aid in controlling the maneuver.

While there have been attempts to provide such attachment, none have been proven to be acceptable in practice. For example, shoes or sandal-like footwear have been fitted with hook & loop (VELCRO) designed to adhere to like material applied to the deck of the board. Suction cups have been used in a similar fashion. However, the major drawback to these devices is that they cause a surfer's feet to become generally fixed wherever they first make contact with the surfboard. In practice, a surfer's feet are seldom perfectly placed upon standing, and nearly always require some adjustment before he can perform effectively. If the attachment of surfer to board is strong enough to hold during extreme, and especially aerial, maneuvers it will not allow this adjustment. Conversely, if the strength of the attachment allows repositioning of the feet it will be so weak as to render the system ineffective.

Foot straps, similar to those used for sailboards, have been attached to surfboards. For example, U.S. Pat. No. 5,167,553, issued to K. D. Wilson, discloses a foot strap and means for attachment thereof to a surfboard. The invention comprises an elastic strap member comprising an inner pad, an outer pad and a leaf spring member sandwiched between the inner and outer pads. The spring member has a generally arcuate shape for establishing a generally arcuate shape of the strap member. First fastening means are coupled to a first end of the strap member for pivotally attaching the strap member to a surfboard. Second fastening means are coupled to a second end of the strap member for attaching the strap member to the surfboard, the second fastening means having a flexible portion for allowing the strap member to extend into a flattened configuration on the surface of the surfboard.

Methods using foot straps have drawbacks in practical use. The surfer must insert his foot into such a strap. He must first lift his foot off the board momentarily then shove it into the strap. This is a very unnatural movement on a surfboard to perform in a split second upon entering a wave. Natural movement on a surfboard is longitudinally forward and aft. On a longer board, the rider walks forward or backward crossing his feet one after the other to trim his board. On small boards the movements are subtle using a twisting forward or backward movement of toes down then heel up and moved forward; then heel down, toes up, then moved forward. This natural movement while maintaining board contact has been taken into account by having the support means often ended to easily enter and exit by moving forward or backward into the surfboard turning position.

SUMMARY OF THE INVENTION

The foot support apparatus of the present invention comprises a resilient hinge including an upper portion hingedly connected to a lower portion. The lower portion is securely attachable to an upper surface of a sportsboard. A strap has a first end connectable to the upper portion and a second end being so connected so as to urge the upper portion toward the upper surface of the sportsboard. Thus, when the user's foot is placed under the upper portion, the user's foot is wedged within the hinge for support. This wedging action and commensurate ability to conveniently and easily move the foot are advantages which have not heretofore been realizable by available foot support systems.

Other objects, advantages, and novel features will become apparent from the following detailed description of the invention when considered in conjunction with the accompanying drawings.

BRIEF DESCRIPTION OF THE DRAWINGS

FIG. 1 is a perspective illustration of a first embodiment of the foot support apparatus of the present invention, which is used for skateboards.

FIG. 2 shows a pair of foot support apparatuses of FIG. 1 being utilized on a skateboard, the user's feet being wedged within the hinge for support.

FIG. 3 is a cross-sectional view of the foot support apparatus of FIG. 1.

FIG. 4 is a side view of the foot support apparatus of FIG. 1, the user's foot being positioned on the upper portion of the hinge to collapse the hinge.

The same parts or elements throughout the drawings are designated by the same reference characters.

DETAILED DESCRIPTION OF THE PREFERRED EMBODIMENTS

Figure 5:
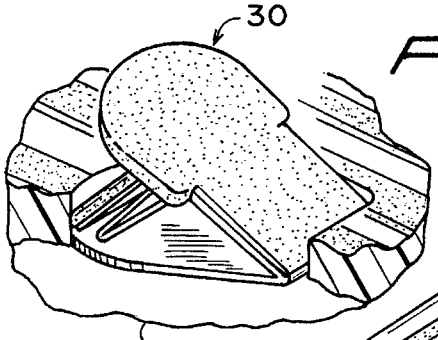
FIG. 5 is a perspective illustration of a second embodiment of the foot support apparatus of the present invention, which is used for surfboards.
Figure 6:
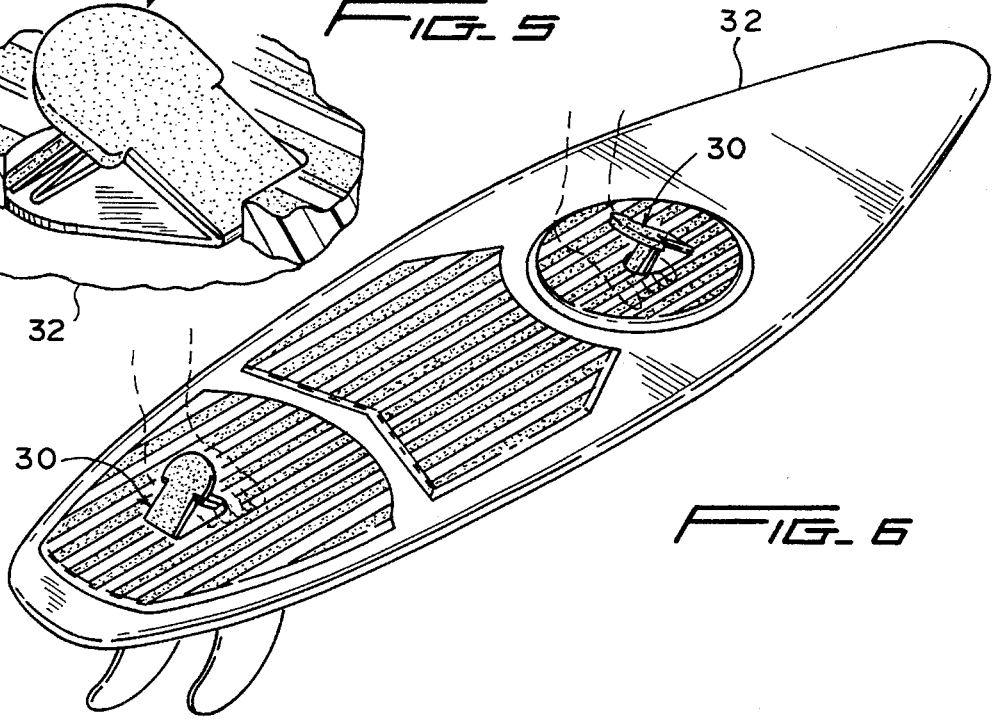
FIG. 6 shows a pair of foot support apparatuses of FIG. 5 being utilized on a surfboard, the user's feet being wedged within the hinge for support.
Figure 7:
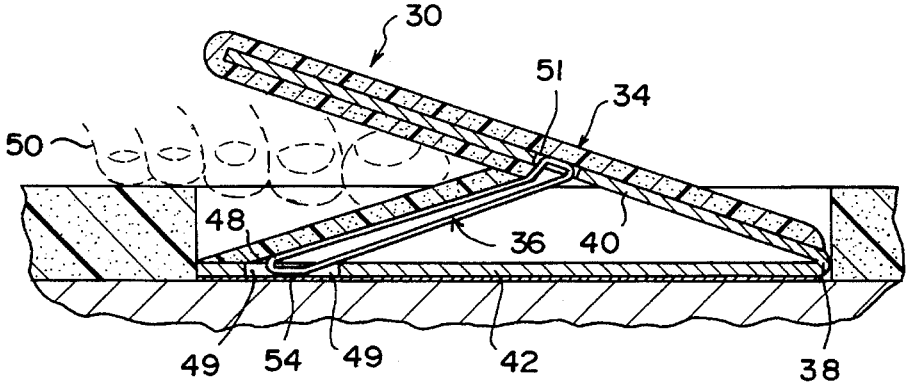
FIG. 7 is a cross-sectional view of the foot support apparatus of FIG. 5.

Referring now to the drawings and the characters of reference marked thereon, FIGS. 1–4 illustrate a first embodiment of the foot support apparatus of the present invention, designated generally as 10, which is preferably used on skateboards. Foot support apparatus 10 includes a resilient hinge, designated generally as 12, and a strap 14. The hinge 12 is an elongated, unitary hinge element having a line 16 of decreased thickness across the width thereof which allows folding thereon at a desired location for forming an upper portion 18 and a lower portion 20 of the hinge 12. Hinge 12 is preferably formed of a resilient plastic material such as polypropylene.

The strap 14 is flexible and has a first, upper end connected to the upper portion 18 of the hinge 12 and a second, lower end connected to the upper surface of a skateboard 22. The lower portion 20 of the hinge 12 is also securely attached to the skateboard 22. Thus, the strap curves along the same direction as the hinge 12. During use, the user's foot 24 may be wedged against the upper portion 18 of the hinge 12, the skateboard 22 and the strap 14.

The strap 14 is preferably formed of webbed nylon material. The lower end of the strap 14 and lower portion 20 may be attached to the skateboard 22 by screws 26 and 28 or other suitable fastening means. Similarly, the upper end of the strap 14 may be attached to the upper portion 18 of the hinge 12 by screw means 29.

Utilization of a pair of opposed apparatuses 10 secured at desired positions on the skateboard 22, provides a foot support system with advantages heretofore not realizable in this sport. The rear apparatus 10 is preferably positioned behind the back wheels. The front apparatus 10 is preferably positioned forward the front wheels. The support system allows the user to actually jump and lift the board. Rotational spins can now be performed by lifting up and spinning 360 degrees or as many rotations as talent permits. The ability to jump and have the board stay attached to your feet is going to open up cross-training of other boardsports like snowboarding using the widely accessible and inexpensive skateboard as a training tool.

As can be seen in FIG. 3, the apparatus 10 can be stepped upon and the hinge collapsed, allowing the user to perform his desired stunts. To reposition his foot, if when stepping on his board he steps on the apparatus 10 for balance, he does not stumble and trip by having a non-yielding support system that would cause him to fall. The collapsing of the system allows him to calmly move his foot forward off the collapsed support system and the support apparatus 10 flips up ready to enter correctly to perform his desired stunts.

Referring now to FIG. 5, a second embodiment of the foot support apparatus of the present invention is illustrated, designated generally as 30, which is particularly adapted for use on a surfboard 32. As in the previous embodiment, foot support apparatus 30 includes a resilient hinge, designated generally as 34, and a strap, designated generally as 36. The hinge 34 is an elongated, unitary hinge element having a line 38 of decreased thickness across the width thereof which allows folding thereon at a desired location for forming an upper 40 and a lower portion 42. Furthermore, as in the previous embodiment, upper and lower portions 40, 42 are preferably formed of resilient plastic, such as polypropylene. An approximate preferred thickness is 3/16". Additionally, as in the previous embodiment, a first upper end of the strap 36 is connected to the upper portion 40. However, in this embodiment, the lower portion 42 is extended so that the second, lower end of the strap 36 is connected to that lower portion 42. Thus, in use, the user's foot is wedged against the upper portion 40 of the hinge 34 and the strap 36.

Padding material is preferably used on the upper surface of the upper portion 40 of the hinge 34, on the lower surface of the upper portion 40, and along the outer side of the strap 36, i.e. the portions of the apparatus 30 which come into contract with the surfer's (typically) barefeet, as shown by numeral designations 44, 46, 48, respectively. Such a padding material may be, for example, E.V.A. foam. It may be adhered to the upper portion or strap by using peel back tape.

The strap 36 preferably comprises a "loop" of webbed nylon material. The lower end of the strap is directed through slots 49 formed in lower portion 42. The upper end of the strap 36 is also directed through slots 51 in the upper portion 34. Although use of this "loop" is preferred, a single strip of webbed material could alternately be used to form the strap.

Figure 8:
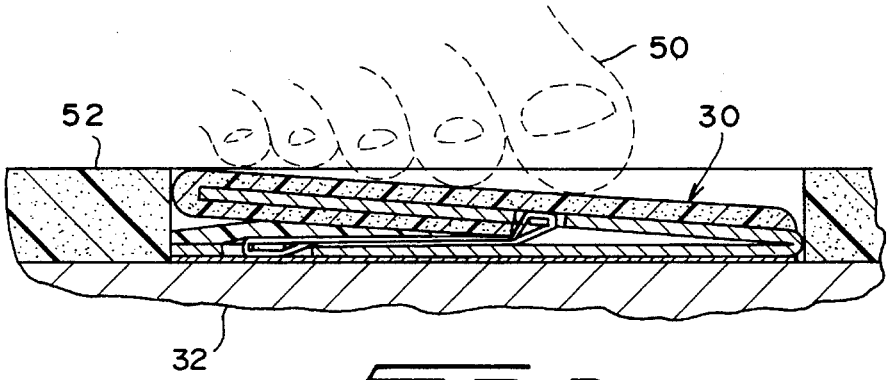
FIG. 8 is a side view of the foot support apparatus of FIG. 5, the user's foot being positioned on the upper portion of the hinge to collapse the hinge.

As can be seen by reference to FIG. 8, as in the previous embodiment, when the surfer desires to release his foot 50 (or feet) from the surfboard 32 he may do so, and actually place his foot or body on the apparatus 30 to collapse hinge 34. In such a collapsed state the top of the hinge 34 is approximately flush with foam padding 52 that is preferably provided around the apparatus 30. Thus, the surfer may rest his foot, feet, or other portions of his body comfortably along any part of the surfboard 30 without impediment by the foot support apparatus 34. This is particularly beneficial when the surfer is paddling.

The lower portion 42 of the hinge 34 is preferably, attached to the surfboard 32 by use of adhesive 54, e.g. with peel back stick tape. Alternate means of attachment involve the use of threaded insert plugs which are secured into the surfboard, then securing the lower portion 42 into these plugs.

In use, when the foot is wedged in place in the hinge, the force of the foot bearing against the strap 36 serves to urge the upper portion 40 downward onto the top of the foot. The tighter that the foot is wedged against the strap, the tighter the hinge 34 closes against the foot 50. This mechanical cinching action, the ability to safely enter and exit, and the collapsibility of the apparatus 30 are particular advantages of the present invention over the prior art.

Additionally, the ergonometric shape of the mating portions of apparatus 30 provide enhanced comfort. Because the foot by nature is a wedge shape thinner at the small toe and thicker at the big toe and instep, when placed in the support apparatus there becomes a mating of the foot into the wedge design of the apparatus adding to not only comfort but also function.

Figure 9:
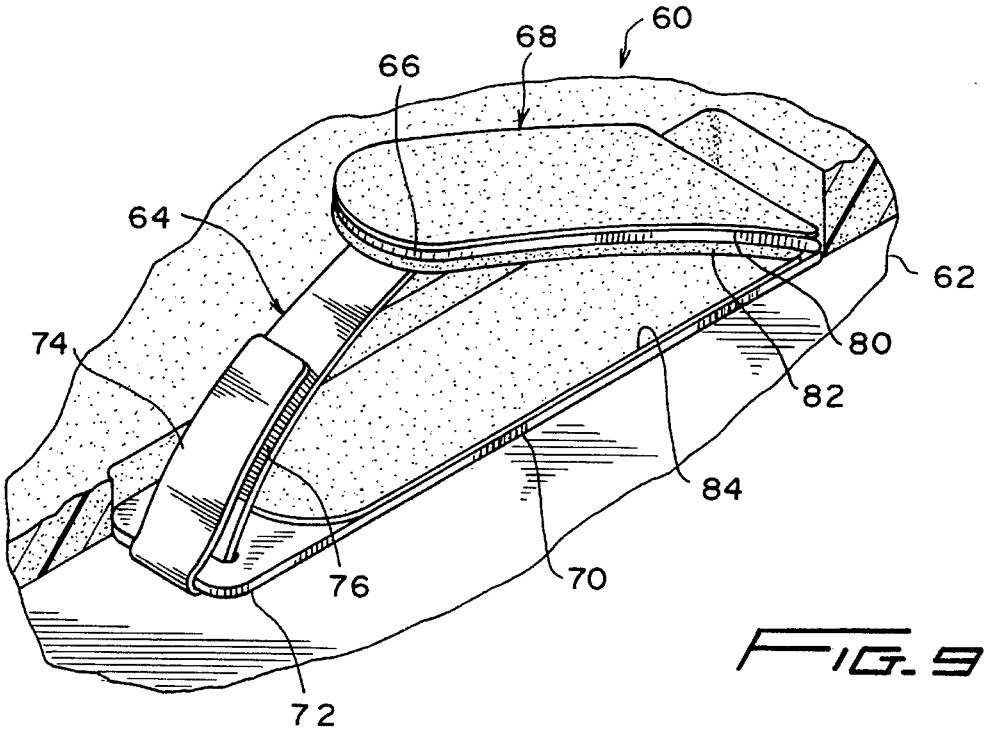
FIG. 9 is a perspective illustration of a third embodiment of the foot support apparatus of the present invention, which is used for surfing.
Figure 10:
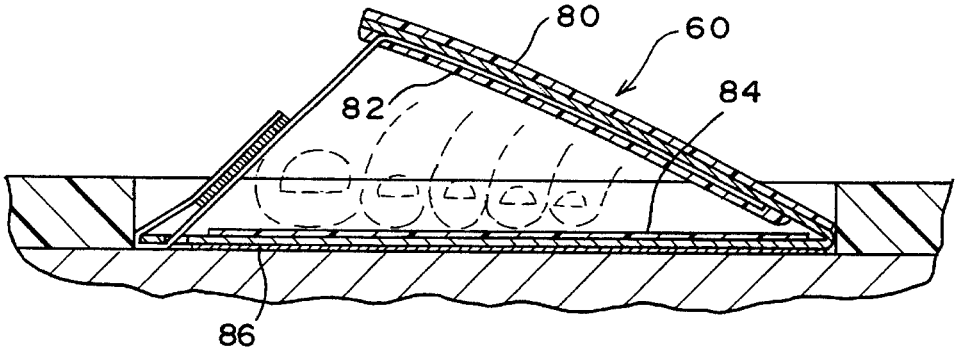
FIG. 10 is a cross-sectional view of the foot support apparatus of FIG. 9.
Figure 11:
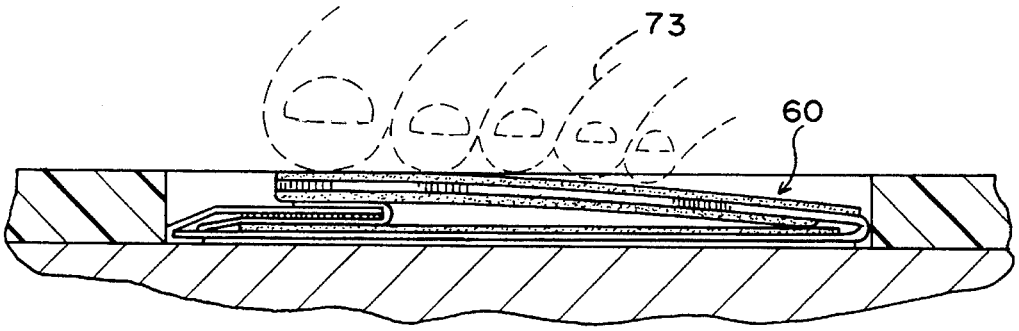
FIG. 11 is a side view of the foot support apparatus of FIG. 9, the user's foot being positioned on the upper portion of the hinge to collapse the hinge.

Referring now to FIG. 9, a perspective illustration of a third embodiment of the foot strap apparatus of the present invention is illustrated, designated generally as 60. As in the previous embodiment, the present embodiment is particularly adapted for use on a surfboard 62. A first, upper end of a strap 64 is connected to an upper portion 66 of a hinge 68, as in the previous embodiments. Furthermore, a second, lower end of the strap 64 is connected to a lower portion 70. However, in this embodiment, the strap 64 is connected to the end 72 of the lower portion 70. The lower portion 70 is sufficiently long so that the user's foot 73 may be inserted between the upper portion 66 and the lower portion 70 and held within the "triangle" completed by the strap 64. A terminal portion 74 of the lower end of the strap 64 is passed through an opening at the end 72 of the lower portion 70 and passed around the end 72. The strap 64 is securely connected to itself by means of fastening material 76 of the type that uses complimentary pieces of hook and loop material.

Padding material 80, 82, 84 is used, as in the previous embodiment, for foot protection. Furthermore, peel back stick tape type adhesive 86 may be used to attach the hinge to the board.

The third embodiment, while not having an open end for ultimate ease for entry as in the second embodiment, has addressed the entry and exit question by use of the padding that surrounds the hinge. By the fact that the padding is higher than the hinge, the toes and the ball of the foot are provided room to go down when the foot is required to enter or exist the hinge quickly. This creates a greater space beneath the hinge. This space creates vertical angles at which the foot can enter or exit the hinge. But, while in the hinge fully wedged, the foot bridges this lower recess thus maintaining a secure force on the upper portion of the hinge. Only when the foot is moved back out and upward does it then find the concave surface lower under the toes. The apparatus 10 is capable of folding flat. This enhances comfort for the chest when in a prone paddling position.

Obviously, many modifications and variations of the present invention are possible in light of the above teachings. For example, although the inventive concepts have been explained above with respect to their implementation with skateboards and surfboards, these concepts are equally applicable with other sportsboards, such as snowboards and windsurfing boards. Furthermore, although the invention has been discussed in detail with respect to the case of a strap, it is also perceivable that the entire device is molded into one piece where the upper and lower portions of the hinge are connected (i.e. tethered) with the same resilient material such as, for example, polypropylene or urethane rubber. Such a hinge would preferably involve thickening various portions of the hinge in one monolithic injection. Such a tethering technique, involving a unitary material, still allows the upper portion of the hinge to move toward the upper surface of the sportsboard when the user's foot is placed (i.e. wedged) under the upper portion, within the hinge. It is, therefore, to be understood that within the scope of appended claims, the invention may be practiced otherwise than as specifically described.

What is claimed and desired to be secured by Letters Patent of the United States is:

1. A foot support apparatus for supporting a user's foot relative to a sportsboard comprising:

a) a resilient hinge having a lower portion securely attachable to an upper surface of a sportsboard and an upper portion having a first end and a second end, the second end being hingedly connected to said lower portion and being located outwardly of said first end when the hinge is secured to the sportsboard; and b) a strap having a first end connected to said upper portion at a first connection point and a second end connected to one of the upper surface of the sportsboard and the lower portion, said upper portion being biased to a raised position away from said lower portion, and a lower surface of said upper portion having a foot engageable portion extending between said first connection point and the first end of said upper portion, wherein the foot engageable portion of said lower surface, together with at least a portion of said strap which extends between the user's foot and an upper surface of the sportsboard, forms an open ended region within which a user's foot may be wedged for support when the upper portion is in the raised position.

2. The foot support apparatus of claim 1 wherein said resilient hinge comprises an elongated, unitary hinge element with a portion thereon having a decreased thickness which allows folding thereon, thereby forming said upper and lower portions and relative folding thereof.

3. The foot support apparatus of claim 1 wherein said sportsboard comprises a skateboard and wherein said resilient hinge comprises an elongated, unitary hinge element having a line of decreased thickness across the width thereof which allows folding thereon at a desired location for forming said upper and lower portions and relative folding thereof, said second end of said strap being securely attachable to said skateboard and said lower portion also being securely attachable to said skateboard so that the user's foot may be wedged against said upper portion of said hinge, said skateboard, and said strap.

4. The foot support apparatus of claim 1 wherein said sportsboard comprises a surfboard and wherein said resilient hinge comprises an elongated, unitary hinge element having a line of decreased thickness across the width thereof which allows folding thereon at a desired location for forming said upper and lower portions and relative folding thereof, said second end of said strap being securely attached to said lower portion of said hinge so that the user's foot may be wedged against said upper portion of said hinge and said strap.

5. The foot support apparatus of claim 4 further including padding material located on the upper surface of said upper portion of said hinge and on the lower surface of said upper portion and along said strap which come in contact with the user's foot when the foot is wedged within the apparatus.

6. The foot support apparatus of claim 1 wherein the upper portion of the hinge is configured so as to lie substantially parallel with the lower portion when the user's foot is placed thereon.

7. A pair of foot support apparatus for supporting a user's foot relative to a sportsboard, each apparatus being securely attachable at a desired position on a sportsboard to support a respective foot of the user, each foot support apparatus comprising:

a) a resilient hinge having a lower portion securely attachable to an upper surface of a sportsboard and an upper portion having a first end and a second end, the second end being hingedly connected to said lower portion and being located outwardly of said first end when the hinge is secured to the sportsboard; and b) a strap having a first end connected to said upper portion at a first connection point and a second end connected to one of the upper surface of the sportsboard and the lower portion, said upper portion being biased to a raised position away from said lower portion, and a lower surface of said upper portion having a foot engageable portion extending between said first connection point and the first end of said upper portion, wherein the foot engageable portion of said lower surface, together with at least a portion of said strap which extends between the user's foot and an upper surface of the sportsboard, forms an open ended region within which a user's foot may be wedged for support when the upper portion is in the raised position.

* * * * *